United States Patent [19]

Crase

[11] Patent Number: 4,531,766

[45] Date of Patent: Jul. 30, 1985

[54] RELEASABLE COUPLINGS FOR DRILL STRINGS

[76] Inventor: Gary M. Crase, 5765 La Jolla Way, Cypress, Calif. 90630

[21] Appl. No.: 298,023

[22] Filed: Aug. 31, 1981

[51] Int. Cl.[3] ..... F16L 55/00; F16L 37/00; F16L 39/00

[52] U.S. Cl. ..... 285/18; 285/3; 285/319; 285/DIG. 23

[58] Field of Search ..... 285/3, 4, 18, 319, DIG. 23

[56] References Cited

U.S. PATENT DOCUMENTS

| | | | |
|---|---|---|---|
| 3,051,244 | 8/1962 | Litchfield | 285/DIG. 23 |
| 3,148,894 | 9/1964 | Schwab | 285/3 |
| 4,161,216 | 7/1979 | Amancharla | 285/18 X |

*Primary Examiner*—Richard J. Scanlan, Jr.

[57] ABSTRACT

A releasable coupling or safety sub for a drill string including an inner tubular member piloted within an outer tubular member, the inner member including expansible, segmental lock members shiftable laterally of the tubular members into locking engagement with a transverse shoulder on the outer member, a retaining member holding the lock members outwardly in engagement with the shoulder, release of the retainer member from the lock members enabling the latter to move laterally inwardly to a position released from the shoulder, permitting the tubular members to be separated from one another. The coupling includes a device for imposing an axial preload on the inner and outer members to place the outer member in compression and the inner member in tension to provide a rigid structure.

21 Claims, 6 Drawing Figures

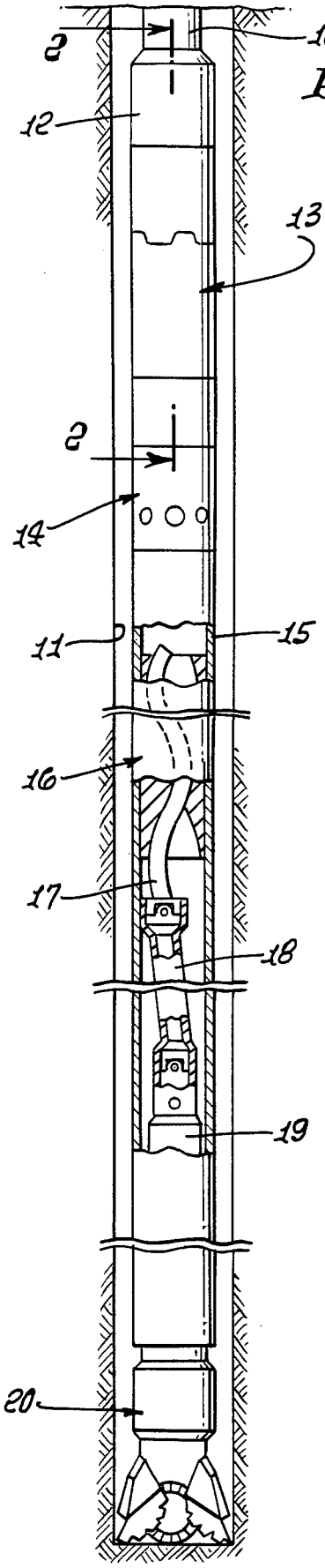
FIG. 1.
FIG. 4.
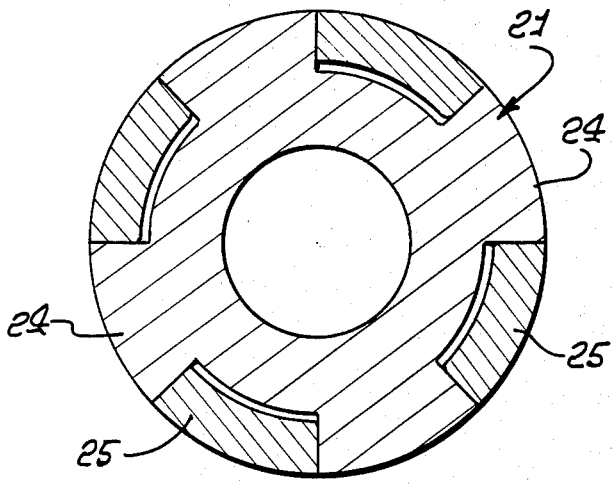
FIG. 5.
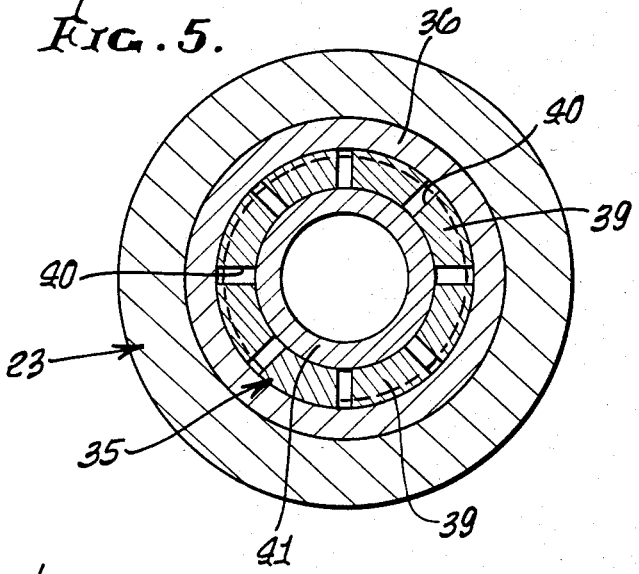
FIG. 6.
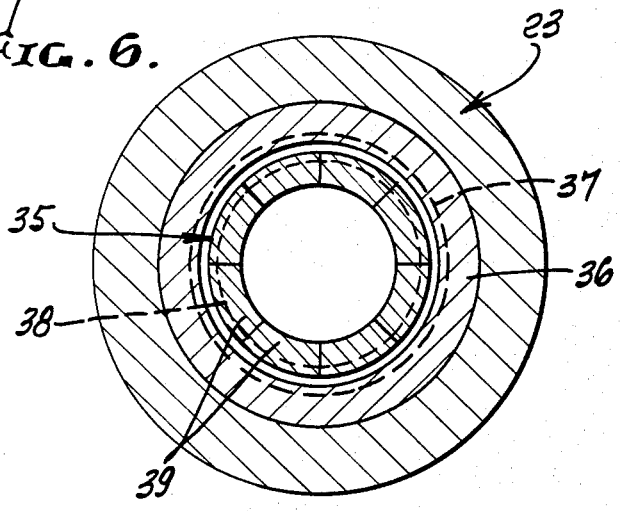

RELEASABLE COUPLINGS FOR DRILL STRINGS

The present invention relates to safety joints or releasable couplings, and more particularly to releasable couplings to be embodied in a drill string attached to a drill bit used in drilling a bore hole in earth formations.

As disclosed in FIG. 4 of U.S. Pat. No. 3,148,894, a safety, releasable joint is embodied in a drill string connected to a drill bit for use in drilling a bore hole in earth formations. In the event the drill bit or drill pipe becomes struck in the well bore, the safety joint can be released and the upper portion of the drill string separated from the lower portion and withdrawn to the top of the well bore. The particular safety joint illustrated in the patent is inordinately lengthy, which creates problems in the event of its use in conjunction with a subsurface fluid motor and a bent sub in performing directional drilling operations in a well bore.

The safety joint shown in FIG. 4 of the above patent does not have its coengaging parts fitting tightly to one another, resulting in the parts being in a slack condition and subject to relative movement with respect to one another, which can create difficulties in the proper operation of the safety joint.

Applicant's safety joint or releasable coupling is relatively compact, which enables the coupling to be made shorter. Moreover, it is axially preloaded, which insures tightness between its coengaging parts. Applicant's releasable coupling embodies an upper inner tubular member telescoped within a lower outer member having interengaging parts for transmitting torque between the members. The outer member has a transverse shoulder and carries circumferentially spaced lock members shiftable transversely to a position engaging the transverse shoulder so that the inner member exerts an upward force on the lock members and against the transverse shoulder. The inner and outer members have thrust surfaces engaging each other, such that downward thrust is transmitted from the inner member to the outer member.

The lock members are held in thrust transmitting engagement with the transverse shoulder by a retainer member which prevents the segmental lock members from shifting laterally inwardly free from engagement with the tapered shoulder. Removal of the retainer member from the lock members enables the latter to move inwardly clear of the transverse shoulder. The drill pipe connected to the inner member and disposed above the inner member can then be elevated for complete removal from the well bore.

The preload device is embodied in the releasable coupling to impose an axial preload between the locking members and the transverse shoulder and a compressive force between the inner and outer members to prevent any slack from remaining in the assembled tool.

This invention possesses many other advantages, and has other purposes which may be made more clearly apparent from a consideration of a form in which it may be embodied. This form is shown in the drawings accompanying and forming part of the present specification. It will now be described in detail, for the purpose of illustrating the general principles of the invention; but it is to be understood that such detailed description is not to be taken in a limiting sense.

REFERRING TO THE DRAWINGS

FIG. 1 is a combined side elevational and longitudinal sectional view through a combination of a drill bit, fluid motor, dump valve, safety joint and bent sub for drilling a well bore;

Figure 2:
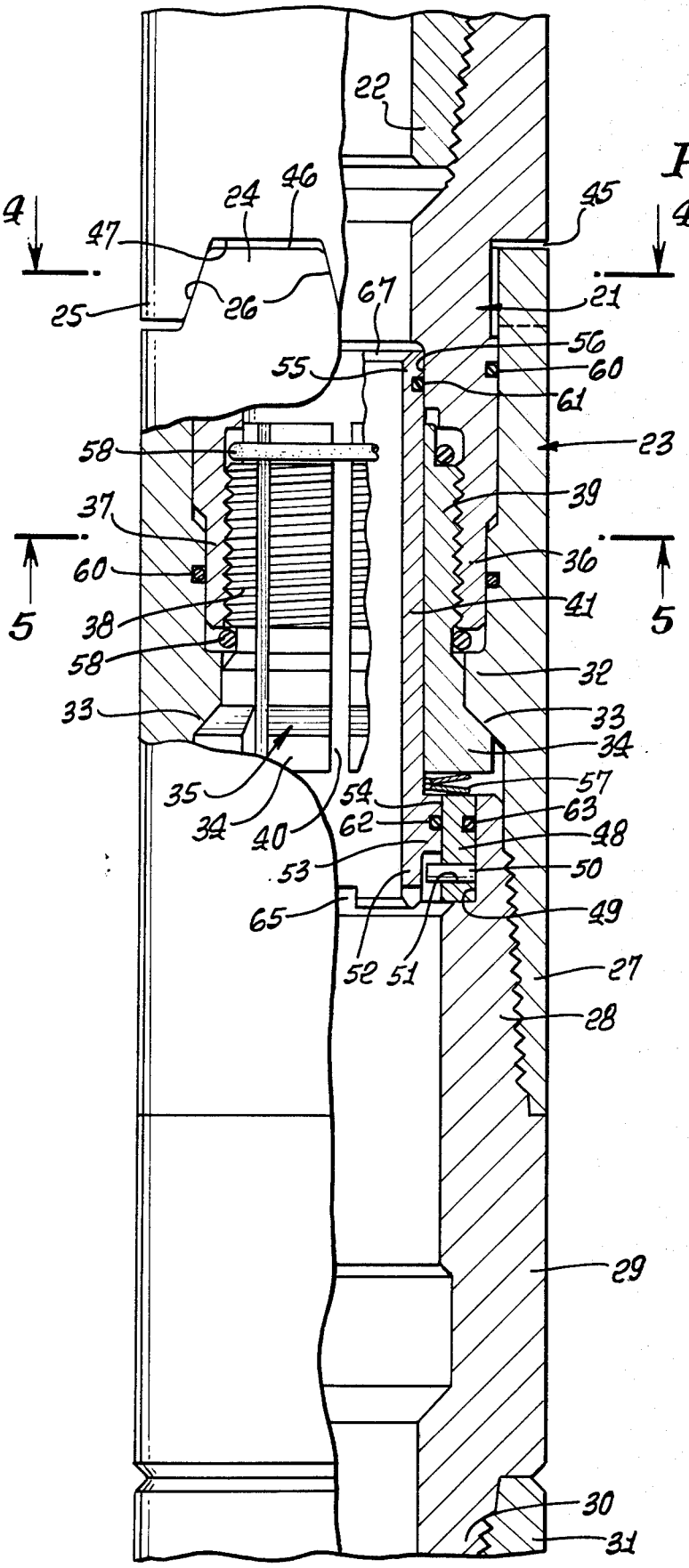
FIG. 2 is an enlarged side elevational view and and longitudinal section taken along the line 2—2 on FIG. 1.
Figure 3A:
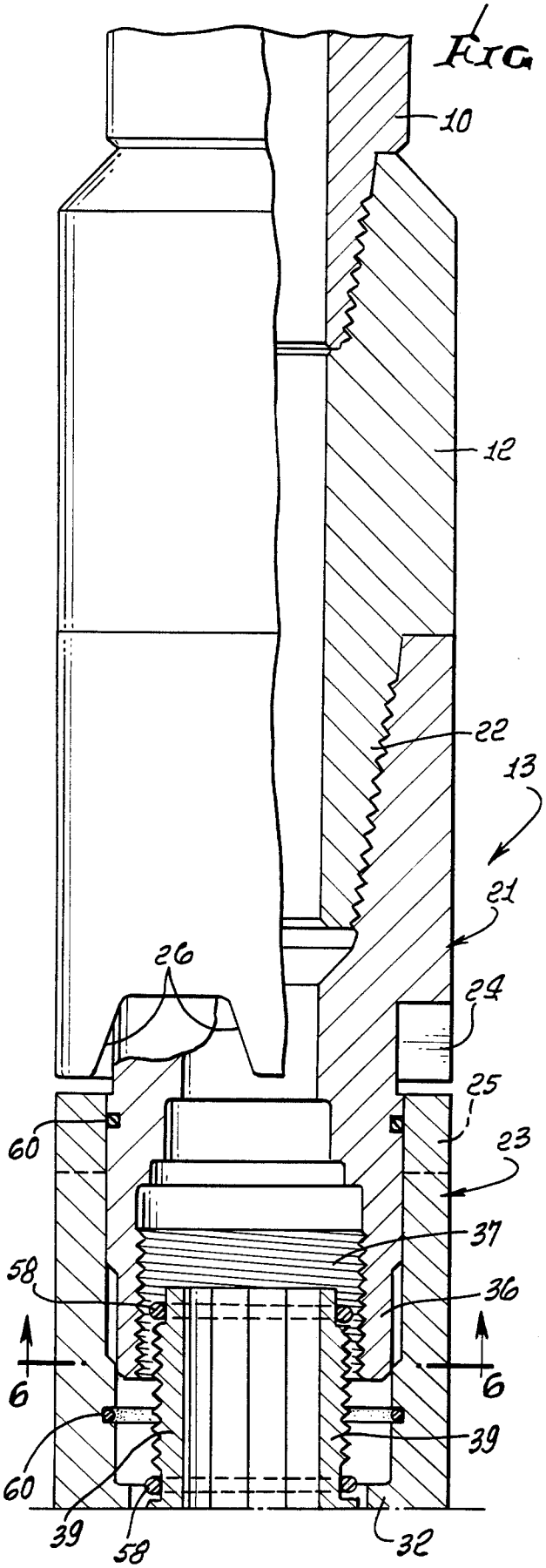
Figure 3B:
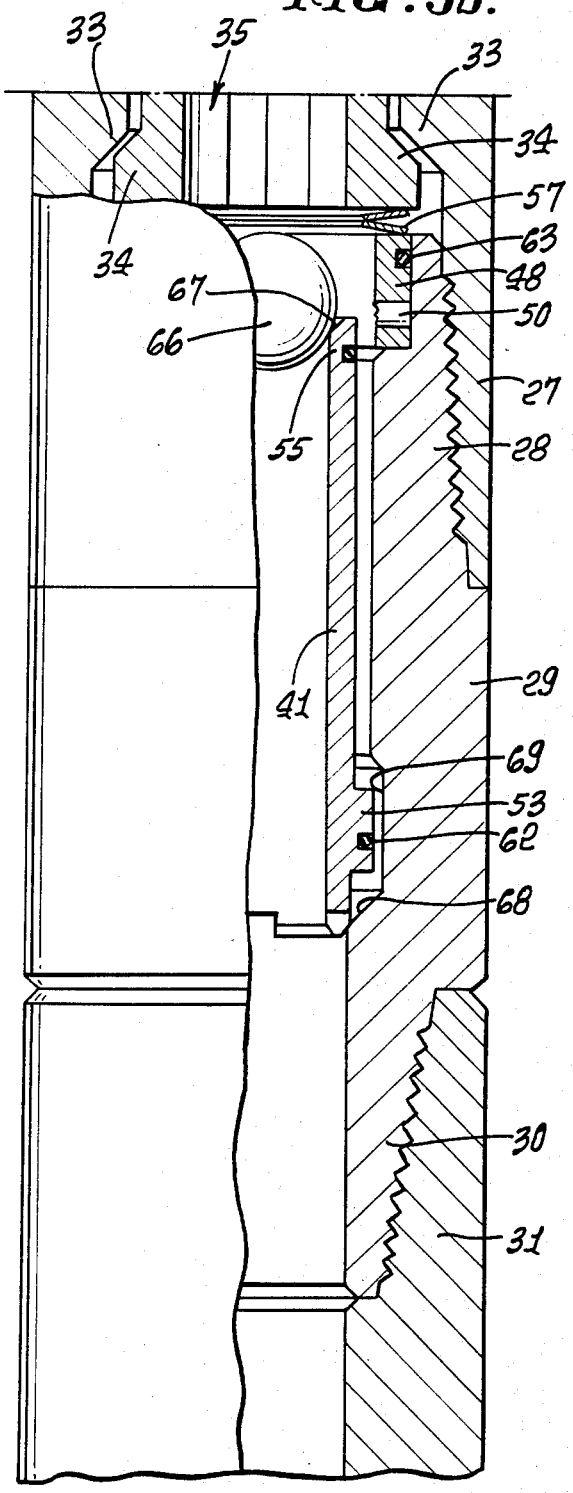

FIGS. *3a* and *3b* are views corresponding to FIG. 2 with the safety joint or releasable coupling in a released condition for removal of the drilling string to the top of the well bore, FIG. *3b* being a lower continuation of FIG. *3a;*

FIG. 4 is a cross-section taken along the line 4—4 on FIG. 2;

FIG. 5 is a cross-section taken along the line 5—5 on FIG. 2; and

FIG. 6 is a cross-section taken along the line 6—6 on FIG. *3a.*

As disclosed in FIG. 1, a drill collar or drill pipe 10, forming the lower portion of a drill pipe string extending to the top of a well bore 11 being drilled, is secured to a bent sub 12, such as disclosed in U.S. Pat. No. 4,067,404. The sub 12 is secured to the upper end of a releasable coupling or safety joint 13 connected to a dump valve 14, which may be the type illustrated in U.S. Pat. No. 3,005,507, which is, in turn, secured to the upper end of the stator portion 15 of a fluid motor 16 containing a rotor 17. The rotor is connected to a universal joint 18 connected to the drive shaft 19 of the motor which is secured at its lower end to a drill bit 20 for drilling the well bore 11 to the desired diameter. The drive shaft is suitably rotatably supported, in a known manner, by a bearing assembly (not shown) contained within the stator and through which drilling weight is transmitted to the drill bit 20 and to the bottom of the bore hole. The details of the drill bit, bearing assembly, universal joint, stator, rotor, dump valve, and bent sub are not presented, since they are devices known to the average person skilled in the art. However, the releasable coupling or safety joint 13 is not known, being disclosed specifically in FIGS. 2 to 6, inclusive.

The releasable coupling includes an upper inner housing member 21 having a threaded box receiving a companion threaded pin 22 of the bent sub. The inner tubular member is piloted within an outer tubular housing member 23 which has upper circumferentially spaced axial clutch teeth 24 meshing with companion clutch teeth 25 on the upper inner housing member, the side faces 26 of such teeth being tapered and coengaged to enable torque to be transmitted between the inner and outer members 21, 23. The outer tubular housing 23 member has a lower threaded box 27 threadedly connected to a pin 28 of a lower sub 29 which, in turn, has a lower threaded pin 30 threadedly connected to the box 31 of the dump valve 14 secured to the upper end of the stator of the fluid motor.

The outer tubular housing member 23 has an inwardly directed circumferential flange 32 having a lower tapered shoulder 33 engageable by companion tapered feet or lock members 34 of a segmented connector member or split sleeve 35 extending upwardly along the flange 32 and into the lower skirt portion 36 of the inner housing member which has internal V-shaped threads 37 to receive companion external V-shaped threads 38 on the upper leg portions 39 of the segmented connector, which are integral with the tapered feet 34. Initially, the segmental connector 35 is formed as an integral one-piece part having the external threads 38 extending along its length. The solid or one-piece connector member is then separated into parts by forming slots 40 therethrough from end to end.

A retainer piston or sleeve 41 fits closely within the segmented connector 34, 39 to hold the leg portions 39 in threaded engagement with the internal threads 37 of the inner member 21, the tapered feet 34 being disposed in the outward position illustrated in FIG. 2, and in contact with the tapered shoulder 33 of the outer tubular housing member. The segmented connector member 35 may be considered as forming an extension of the upper, inner housing member 21. Rotation of the segmented connector member causes it to thread upwardly in the inner housing member until the feet 34 are fully engaged with the tapered lower shoulder 33. Continued turning of the segmented member and its upward threaded movement within the inner housing member 21 relatively shifts the inner housing member 21 downwardly within the outer housing member 23 and causes the wedge shaped clutch teeth 24 on the inner and outer members to be wedged against one another with their tapered side surfaces 26 fully engaging one another. Appropriate tightening of the threaded connector member 35 within the inner housing member 21 will impose a preload between the tapered shoulder surface 33 and the companion tapered surfaces of the connector feet 34, and also a preload between the tapered side surfaces 26 of the clutch teeth 24, 25 against one another. After full tightening has occured, spaces 45 will remain between the outer ends 46 of the clutch teeth and the opposed surfaces 47 at the inner ends of the clutch teeth.

A retainer ring 48 having a larger inside diameter than the inside diameter of the connector member 35 is disposed in a counterbore 49 in the pin 28 of the bottom sub 29 of the releasable coupling. A radial shear pin 50 is mounted in a bore 51 in the retainer ring, extending toward the periphery of the lower portion 52 of the retainer piston or sleeve 41, which has an enlarged head or boss 53 extending outwardly therefrom and slidably received in the inner wall 54 of the retainer ring 48. So long as the shear pin 50 is intact, the retainer piston will extend upwardly through the segmented lock members 35, the upper portion 55 of the piston being piloted within a companion surface 56 in the upper inner housing member 21. Belleville springs 57 are disposed around the retainer piston and above the enlargement 53 on the latter located within the retainer ring, the lower end of the springs bearing against the retainer ring 48 and the upper end against the lower surfaces of the lock segment feet 34.

Elastic retractor bands or "O" rings 58 encircle the lock member segments at longitudinally spaced locations so as to tend to contract the lock members when the retainer piston 41 has been removed from its holding position behind the segments, as described hereinbelow.

To prevent fluid leakage between the upper and lower members 21, 23, suitable seal rings 60, longitudinally spaced from one another, are carried by one of the members and sealingly engage the opposed surface of the other member. Similarly, a suitable seal ring 61 is mounted on the upper portion of the retainer piston 41 which sealingly engages the companion inner wall 56 on the inner housing member 21 when the piston is in its upper position within the inner member, to prevent leakage therebetween. The lower head 53 of the retainer piston also carries a seal ring 62 sealingly engaging the inner surface 54 of the retainer ring 48, which carries a suitable seal ring 63 engaging the inner wall of the counterbore 49, to prevent leakage of fluid between the lower portion of the retainer piston and retainer ring, as well as between the latter and an inner surface 49 of the lower sub 29.

The lower end of the retainer piston 41 is provided with circumferentially spaced radial recesses 65 to indicate a pressure drop when the piston 41 is fully disengaged.

In the operation of the releasable coupling, the parts are all connected and locked together in the position illustrated in FIG. 2. In the event the coupling is to be released, as by the drill bit becoming stuck in the well bore, a suitable tripping device 66, such as a ball, is pumped down the drill string, or allowed to gravitate through the drilling fluid in the drill string, until it engages its companion valve seat 67 in the upper end of the retainer piston. Pressure is then applied to the fluid in the drilling string above the ball 66 to urge the retainer piston 41 in a downward direction until the lower piston head 53 engages the shear pin 50. When sufficient pressure is applied, the lower piston head will shear the pin's inner end, freeing the piston, which can then shift downwardly of the apparatus until its lower end engages a stop shoulder 68 in the lower portion of the bottom sub 29, the lower piston head 53 then being disposed in a circumferential recess 69 in the bottom sub 29 permitting fluid to bypass around the retainer piston 41, as disclosed in FIGS. 3*a* and 3*b*, the piston 41 and trip ball 66 then being completely below the lock segments 34, 39 which are retracted from the internal thread 37 within the inner member by the contraction of the elastic rings 58. The upper inner member 21 is now free to be moved by the drill pipe string thereabove completely out of the lower outer member 23, the clutch teeth 24, 25 having been disengaged from one another. The drill string and other devices that might be connected thereto above the inner member, such as a bent sub, are now free to be elevated in the well bore to the top of the latter.

The Belleville springs 57 are provided to insure against loosening of the segmented lock members 35 after they have been threaded fully into the upper inner member 21 and placed in a tight condition with the tapered feet firmly engaging the tapered shoulder 33 on the outer member 23, and the companion clutch teeth 24, 25 securely wedged against one another. Tightening of the lock members to the extent indicated is obtained before the retainer piston 41, retainer ring 48, Belleville springs 57 and bottom sub 29 are assembled in place. A suitable wrench (not shown) is inserted in the sleeve slots 40 and the wrench turned to thread the lock members firmly into the upper member 21 and tightly secured thereagainst, with the tapered feet engaging the tapered shoulder and the clutch teeth firmly wedged against one another. The Belleville springs 57 are then mounted over the upper end of the retainer piston 41 to a location above the lower head 53, after which the retainer ring 48, with the shear pin 50 mounted therein, is disposed around the lower portion of the piston sleeve and with the retainer ring properly mounted around the lower piston head, with the shear pin 50 disposed under the piston head.

The sub assembly just described is then moved into the previously tightened segmented lock members 35, until the Belleville springs engage the lower ends of the segmented lock members 35, the retainer piston 41 then being in the position disclosed in FIG. 2, in which the upper end is piloted within the surface 56 in the upper inner housing member 21. The bottom sub 29 is then threaded into the lower box 27 of the outer member 23, until the counterbore 49 moves over the retainer ring 48. Tightening of the sub 29 within the threaded box 27 will cause the bottom of the counterbore 49 to bear against the retainer ring 48, moving the latter upwardly to compress the Belleville springs between the retainer ring and the lower surfaces on the segmental foot portions of the segmented lock members 35, the Belleville springs being compressed against the foot portions 34 to prevent inadvertent unthreading or loosening of the lock member segments 34, 39.

I claim:

1. A safety joint for a tubular string adapted to be disposed in a well bore, comprising a lower outer tubular member having a transverse inner shoulder, an inner tubular member telescopically disposed in said outer tubular member, lock members carried by said inner tubular member and axially shiftably mounted in said inner tubular member and shiftable laterally into a position for engagement with said shoulder to transmit upwardly directed axial thrust from said lock members to said shoulder, a retaining member disposed behind said lock members to prevent said lock members from retracting inwardly away from said shoulder, said retaining member extending upwardly from said lock members along said inner tubular member and supported by said inner tubular member, and means for moving said retaining member downwardly along said inner tubular member and from holding engagement with said lock members to enable said lock members to retract inwardly from said shoulder and permit upward movement of said inner tubular member from said outer lower tubular member.

2. A safety joint as defined in claim 1 and clutch means for transmitting torque between said inner and outer members.

3. A safety joint as defined in claim 1; and said means for axially shifting said lock members transmitting downwardly directed axial thrust from said inner member to said lower member.

4. A safety joint as defined in claim 1; and releasable means preventing said retaining member from moving from holding engagement with said lock members.

5. A safety joint as defined in claim 1; a clutch between said upper and lower tubular members, said clutch including clutch teeth and means for imparting an axial preload between said lock members and shoulder and also between said clutch teeth.

6. A safety joint for a tubular string adapted to be disposed in a well bore, comprising a lower outer tubular member having a transverse inner shoulder, an inner tubular member telescopically disposed in said outer tubular member, lock members carried by said inner member and shiftable laterally into a position for engagement with said shoulder to transmit upwardly directed axial thrust from said lock members to said shoulder, a retaining member disposed behind said lock members to prevent said lock members from retracting inwardly away from said shoulder, means for moving said retaining member downwardly along said inner member and from holding engagement with said lock members to enable said lock members to retract inwardly from said shoulder and permit upward movement of said inner member from said lower member, and means for imparting an axial preload between said lock members and shoulder and also between said tubular members.

7. A safety joint for a tubular string adapted to be disposed in a well bore, comprising a lower outer tubular member having a transverse inner shoulder, an inner tubular member telescopically disposed in said outer tubular member, lock members carried by said inner member and shiftable laterally into a position for engagement with said shoulder to transmit upwardly directed axial thrust from said lock members to said shoulder, a retaining member disposed behind said lock members to prevent said lock members from retracting inwardly away from said shoulder, means for moving said retaining member downwardly along said inner member and from holding engagement with said lock members to enable said lock members to retract inwardly from said shoulder and permit upward movement of said inner member from said lower member, and means for imparting an axial preload between said lock members and shoulder and also between said tubular members; said preload means comprising a threaded connection between said lock members and said inner tubular member.

8. A safety joint as defined in claim 6; said preload means comprising said lock member threadedly secured to one of said tubular members and imposing an axial thrust on the other of said tubular members.

9. A safety joint for a tubular string adapted to be disposed in a well bore, comprising a lower outer tubular member having a transverse inner shoulder, an inner tubular member telescopically disposed in said outer tubular member, lock members carried by said inner member and shiftable laterally into a position for engagement with said shoulder to transmit upwardly directed axial thrust from said lock members to said shoulder, a retaining member disposed behind said lock members to prevent said lock members from retracting inwardly away from said shoulder, means for moving said retaining member downwardly along said inner member and from holding engagement with said lock members to enable said lock members to retract inwardly from said shoulder and permit upward movement of said upper member from said lower member, said inner tubular member having an internal thread, said lock members having an external thread held in mesh with said internal thread by said retaining member.

10. A safety joint as defined in claim 9; and means for imparting an axial preload between said lock members and shoulder and also between said tubular members.

11. A safety joint as defined in claim 9; clutch teeth in said inner tubular member meshing with clutch teeth on said lower tubular member to transmit torque between said tubular members, said teeth having tapered side faces, whereby said clutch teeth wedge against each other upon tightening engagement of said lock members with said transverse shoulder and threading of said lock members in said internal thread.

12. A safety joint as defined in claim 9; and spring means compressed against said lock members to retain said lock members in a tightened condition with said internal thread.

13. A safety joint as defined in claim 12; said spring means comprising one or more conical spring discs.

14. A safety joint as defined in claim 12; a bottom sub threadedly connected to said outer member and engaged with said spring means to compress said spring means against said lock members.

15. A joint for a tubular string comprising an upper tubular member and a lower tubular member, said tubular members telescopically mounted with respect to each other, locking member axially adjustably connected to the interior wall of one of said tubular members and extending into the other of said tubular members, said locking member formed with a foot engaging a shoulder on said other tubular member whereby on axial adjustment of said locking member with respect to said one of the tubular members, a thrust is imposed between said locking member and said other of the tubular members.

16. The joint of claim 15, in which the locking member is composed of a plurality of locking sections circumferentially spaced from each other about the interior of said one tubular member and extending longitudinally in the interior of said one tubular member.

17. The joint of claim 15, including a piston sleeve telescopically mounted with respect of said locking member holding said foot in engagement with said shoulder.

18. The joint of claim 16, including a piston sleeve telescopically mounted with respect of said locking member holding said foot in engagement with said shoulder.

19. The joint of claim 15, clutch teeth on each of said tubular members in engagement with each other.

20. The joint of claim 19, in which the locking member is composed of a plurality of independent locking sections circumferentially spaced from each other about the interior of said one tubular member and extending longitudinally in the interior of said tubular members.

21. The joint of claim 19, including a piston sleeve telescopically mounted with respect of said locking member holding said foot in engagement with said shoulder.

* * * * *